US006155481A

United States Patent [19]

Rawlings

[11] Patent Number: 6,155,481

[45] Date of Patent: Dec. 5, 2000

[54] RETURNABLE MAILER

[75] Inventor: Timothy W. Rawlings, Waynesville, Ohio

[73] Assignee: NCR Corporation, Dayton, Ohio

[21] Appl. No.: 09/261,779

[22] Filed: Mar. 3, 1999

[51] Int. Cl.[7] ..... B65D 27/06

[52] U.S. Cl. ..... 229/300; 229/301; 283/105

[58] Field of Search ..... 229/300, 301, 229/305, 306; 283/101, 103, 105, 51; 40/312, 630

[56] References Cited

U.S. PATENT DOCUMENTS

| | | | |
|---|---|---|---|
| 107,166 | 9/1870 | Davis | 229/305 X |
| 709,805 | 9/1902 | Sterns et al. | 229/301 X |
| 1,245,447 | 11/1917 | Felenchak | 229/301 X |
| 1,303,063 | 5/1919 | Hoock | 229/301 X |
| 2,563,340 | 8/1951 | Kelly | 283/101 X |
| 3,380,648 | 4/1968 | De Lyra | 229/300 X |
| 3,545,669 | 12/1970 | Kinkade | 229/300 |
| 3,822,492 | 7/1974 | Crawley | 229/301 X |
| 4,159,129 | 6/1979 | Lockhart . | |
| 4,479,838 | 10/1984 | Dunsirn et al. . | |
| 4,637,635 | 1/1987 | Levine . | |
| 5,248,082 | 9/1993 | Elmlinger | 229/306 X |
| 5,289,972 | 3/1994 | Sauerwine et al. | 229/305 X |
| 5,360,160 | 11/1994 | Sauerwine et al. | 229/305 X |
| 5,370,302 | 12/1994 | Dyer | 229/300 X |
| 5,383,686 | 1/1995 | Laurash . | |
| 5,413,383 | 5/1995 | Laurash et al. . | |
| 5,520,990 | 5/1996 | Rotermund | 283/105 X |
| 5,547,227 | 8/1996 | Laurash et al. . | |

*Primary Examiner*—Jes F. Pascua
*Attorney, Agent, or Firm*—Francis L. Conte

[57] ABSTRACT

A mailer includes a container having a label for printing a recipient first address, and a return zone for printing a return address. A release liner is integrated with the container below the label which is releasably bonded to the liner. The liner contains a recipient second address hidden behind the label, which is viewable upon removal of the label for reusing the mailer.

19 Claims, 5 Drawing Sheets

RETURNABLE MAILER

CROSS REFERENCE TO RELATED APPLICATION

The present invention is related to U.S. patent application Ser. No. 09/261,780, filed concurrently herewith, and entitled "Returnable Shipping Label."

BACKGROUND OF THE INVENTION

The present invention relates generally to mailers, and, more specifically, to reusable mailers.

A mailer provides a container for delivering various items from a sender to a recipient. The most common mailer is an envelope which may have various configurations and sizes. Other mailers include boxes, tubes, and packages for delivering items. Mailers may be sent to the recipient using the US Postal Service, or various private carriers, such as overnight delivery services or local couriers.

In many situations, the sender expects a response from the recipient. This typically occurs when a bill or invoice is sent to a customer for which payment is typically returned by check. The sender may provide a preaddressed return envelope, with or without postage being paid, as a courtesy to the recipient for facilitating the return process.

The additional return envelope adds to the expense of the transaction, and requires the recipient to complete the return address on the envelope and affix additional postage.

Accordingly it is desired to improve the process of sending and returning mailers, and facilitate use by the recipient.

BRIEF SUMMARY OF THE INVENTION

A mailer includes a container having a label for printing a recipient first address. A release liner is integrated with the container below the label which is releasably bonded to the liner. The liner contains a recipient second address hidden behind the label, which is viewable upon removal of the label for reusing the mailer.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
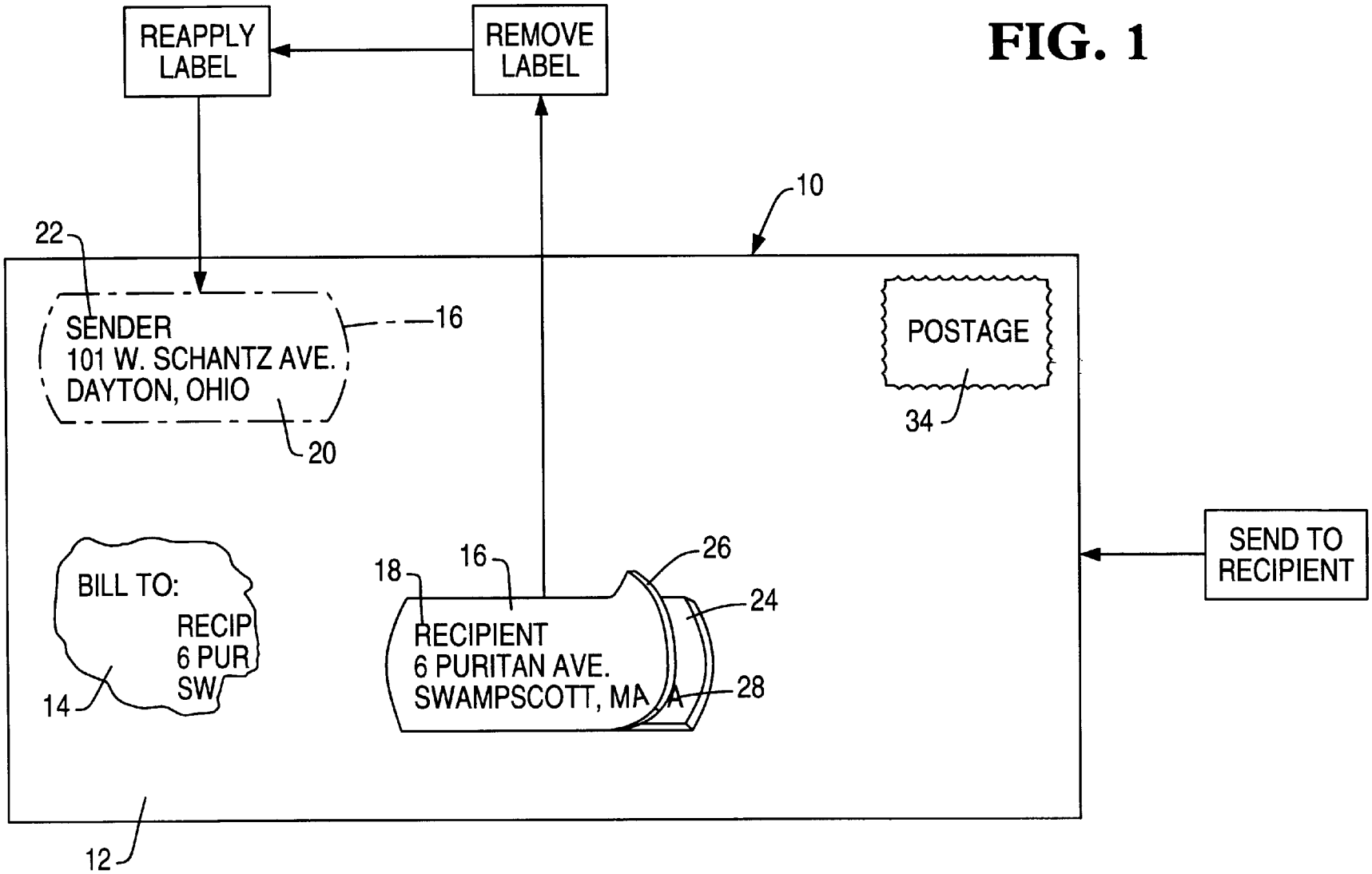
FIG. 1 is a front view of an exemplary mailer and flowchart for its delivery to a recipient and reuse.

Illustrated in FIG. 1 is a mailer 10 in accordance with an exemplary embodiment of the present invention. The mailer includes a container 12 which may have any suitable form such as an envelope of various size and configuration.

Alternatively, the container may be in the form of a delivery box, tube, or other package for shipping an item 14 to a recipient. Shipping may be accomplished by any suitable manner such as the US Postal Service, overnight carriers, or couriers, for example.

In the exemplary embodiment illustrated in FIG. 1, the container 12 is configured as a flat envelope for sending to the recipient an item 14 in the form of one or more sheets of paper such as an invoice or bill requesting payment for a product or services rendered. The item 14 is placed inside the container 12 and suitably sealed therein, with the container having an exposed outer surface on which may be printed the addresses for the specific recipient and the sender.

The container has an exposed label 16 of sufficient size for printing a recipient first address 18 thereon. The container also includes on its front face a return area or zone 20 located in any suitable position for printing a return address 22 thereon.

A release liner 24 is integrated with the container 12 below the label 16. The label is releasably bonded to the liner by a suitable adhesive 26 which covers the back side of the label. The label 16 is preferably a pressure sensitive label which cooperates with the underlying liner 24 in any conventional manner to permit the label to be removed or peeled away from the liner 24 by applying a suitable lifting or peeling force for its removal.

The liner 24 contains a recipient second address 28 printed thereatop which is hidden behind the label 16 prior to label removal. The label may be removed by being peeled away from the liner 24 to expose to view the initially hidden second address 28.

This improved construction of the mailer 10 facilitates the shipment and return of the same container between the sender and recipient in a typical transaction. During the initial construction of the mailer 10, any suitable second address 28 may be printed atop the hidden liner 24. For example, the second address 28 may match the return address 22 in the event the sender wants the container returned. Or, the second address may be to any other location specified by the original sender.

The so preprinted mailer is then used by placing therein the item 14 of any suitable form, such as the exemplary invoice or bill illustrated. The container is suitably sealed closed, and the first address 18 is printed atop the face of the label 16 for the intended recipient. The return address 22 may be printed at the same time the first address is printed, or it may be preprinted along with the second address 28. The mailer 10 is then sent to the recipient at the first address by any suitable service.

Upon receipt, the recipient opens the mailer 10 in any convenient manner for removing the item 14 being sent. The recipient may then use the same mailer 10 for responding to the sender as found in suitable instructions, which may be printed on the back of the container for example. Following the instructions, the recipient conveniently removes the label 16 from atop the liner 24 by peeling it away therefrom to expose the hidden second address 28 therebelow.

In a preferred embodiment, the recipient reapplies or attaches the removed label 16 atop the return zone 20 to hide the original return address 22, with the reapplied label 16 now providing a suitable return address for the reuse of the same mailer. The same adhesive 26 originally found on the label back permits its reattachment to the container, now with a permanent bond.

Figure 2:
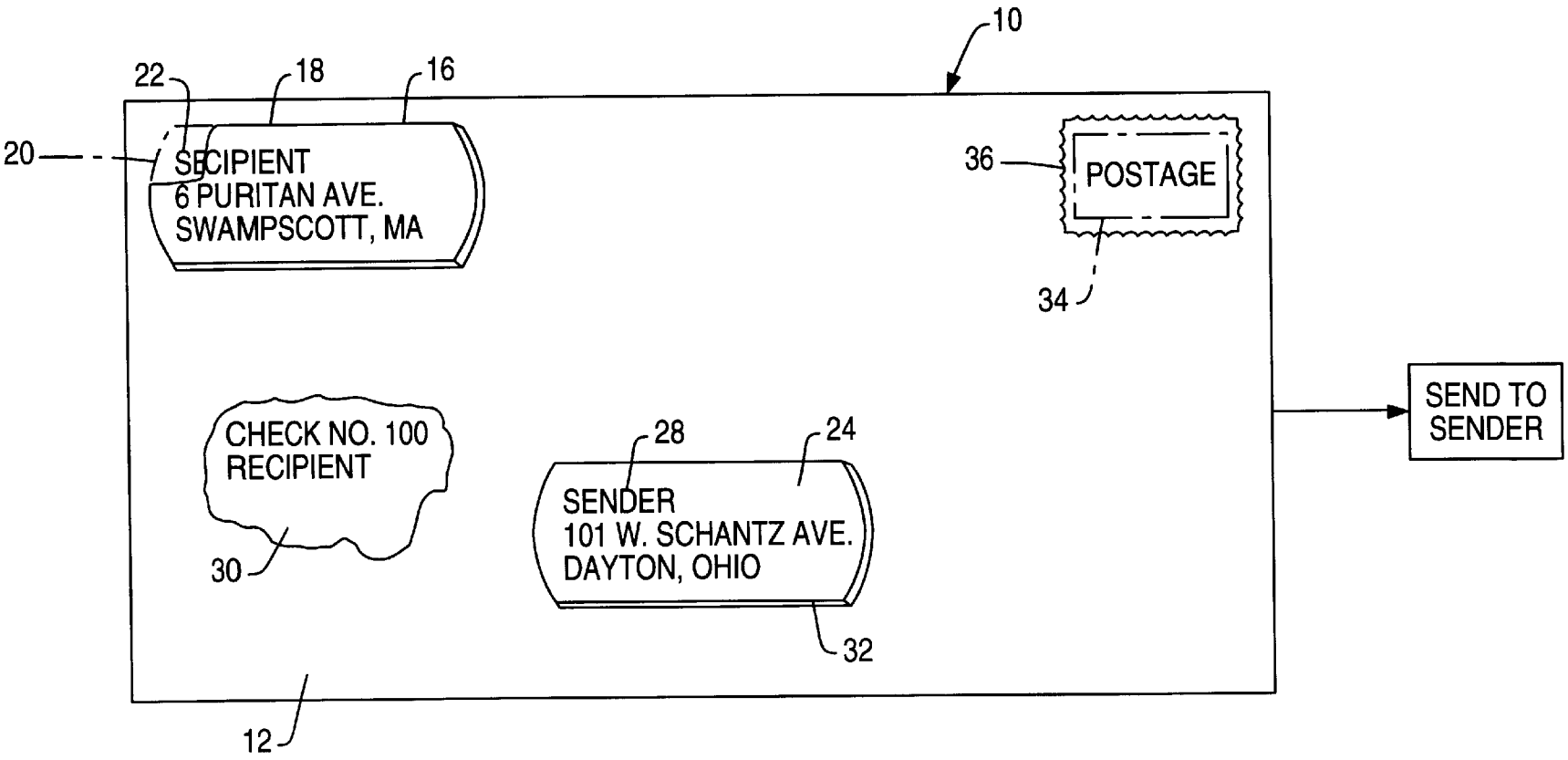
FIG. 2 is a front view of the same mailer and flowchart for its return to a second recipient.

As shown in FIG. 2, the recipient uses the same mailer for sending a suitable return item 30, such as a payment check for example, to the second address 28 now exposed atop the liner 24 in a window 32 defined by the opening for the removed label 16. The container may be reclosed using any suitable means, such as tape.

The mailer is then suitably re-sent to the exposed second address 28, which may be the original sender for example. In the event the original mailer included a postage stamp 34 or bulk mail permit as payment for transportation, the recipient may simply cover the original postage with new postage 36 for retransmittal.

Figure 3:
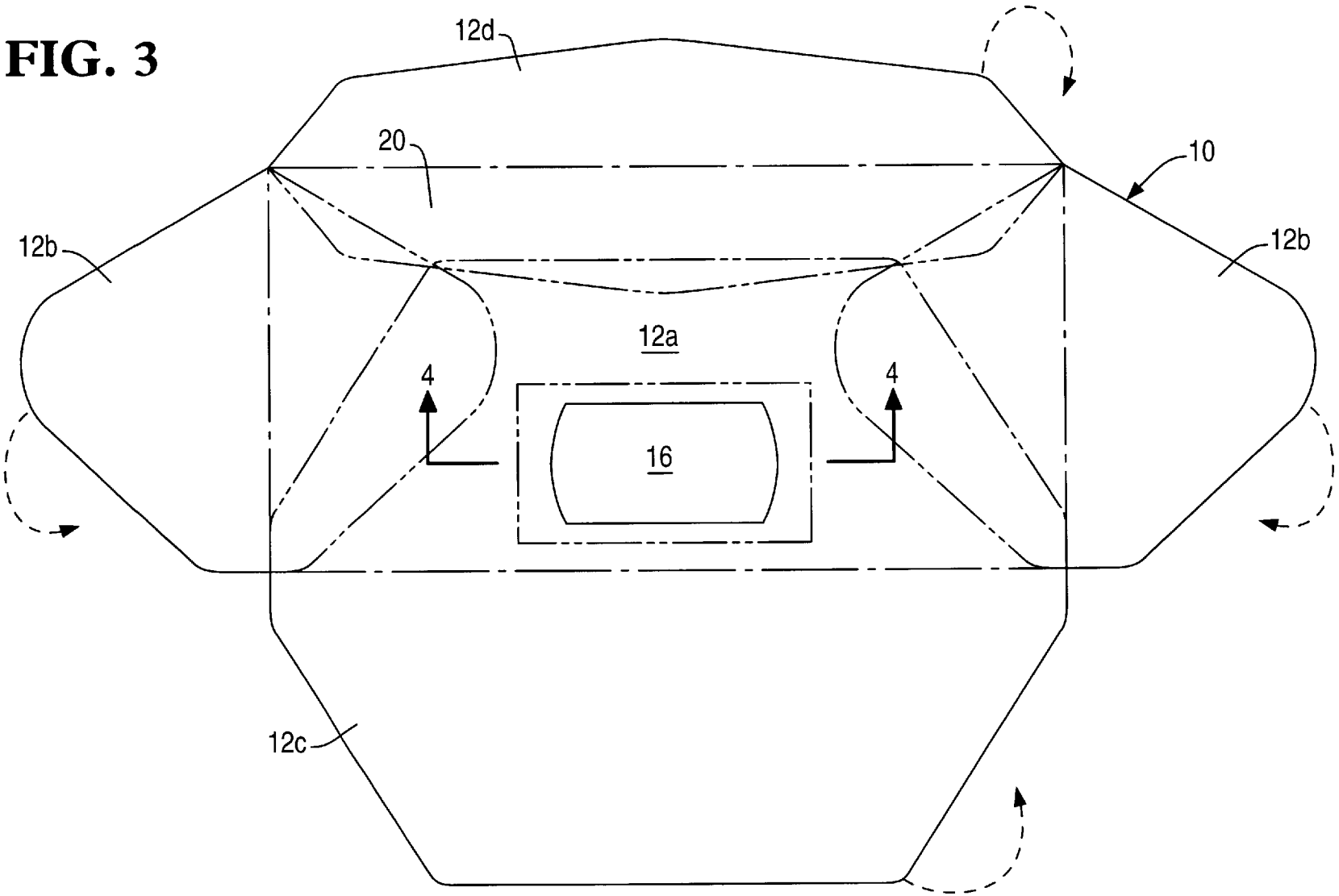
FIG. 3 is an unfolded, flat front view of the mailer illustrated in FIG. 1 showing its construction and assembly.

FIG. 3 illustrates the mailer 10 in the exemplary form of an envelope which may be formed from a single sheet of material, such as paper for example. The container initially includes a face sheet 12*a* which is rectangular in the exemplary configuration and includes both the label 16 and return zone 20. Extending integrally outwardly from the face sheet 12*a* are two side flaps 12*b* and a bottom flap 12*c* which are folded-under below the face sheet and suitably bonded together to form the envelope container in any conventional manner. A top flap 12*d* also extends from the face sheet and includes a suitable adhesive along its edge for closing and sealing the container after an item is inserted in the container.

Figure 4:
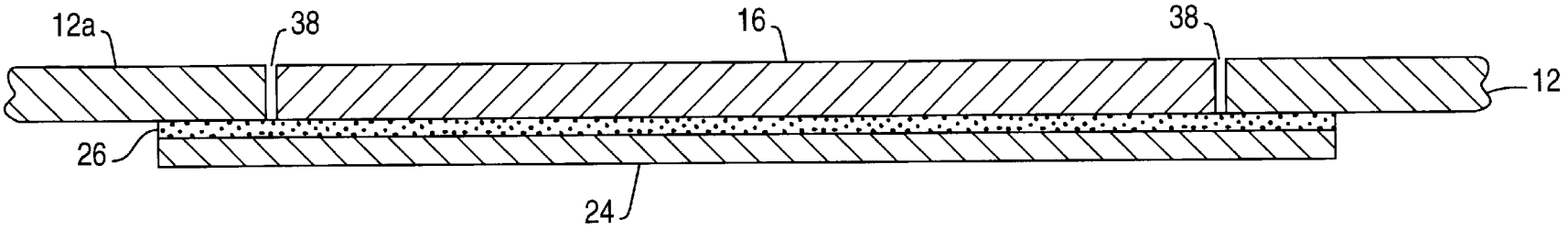
FIG. 4 is a cross sectional view of the mailer illustrated in FIG. 3 and taken along line 4—4.

FIG. 4 illustrates a cross section of the container illustrated in FIG. 3 through the label and supporting liner. The label 16 is preferably parallel and coplanar with the face sheet 12*a*. The adhesive 26 is disposed between the label 16 and liner 24 to form a laminate thereof.

In the preferred embodiment illustrated in FIG. 4, the label 16 is flush with the face sheet 12*a*, with the label being a portion of the face sheet having a perimeter severed therefrom by a conventional die cut 38.

Accordingly, the label 16 may be integrated in the container 12 which is conveniently initially formed in a single sheet of material. The liner 24 is bonded to the back of the face sheet 12*a* with a sufficient border around the label perimeter for maintaining continuity of the face sheet after the die cut 38 is made. The liner also maintains structural continuity of the face sheet after removal of the label 16 from its window.

The liner 24 is preferably bonded to both the back side of the face sheet 12*a* and the back side of the label 16 with the common or same adhesive 26. The adhesive 26 is selected to releasably bond the label 16 to the liner 24 while permanently bonding the liner to the back side of the face sheet around the label.

Figure 5:
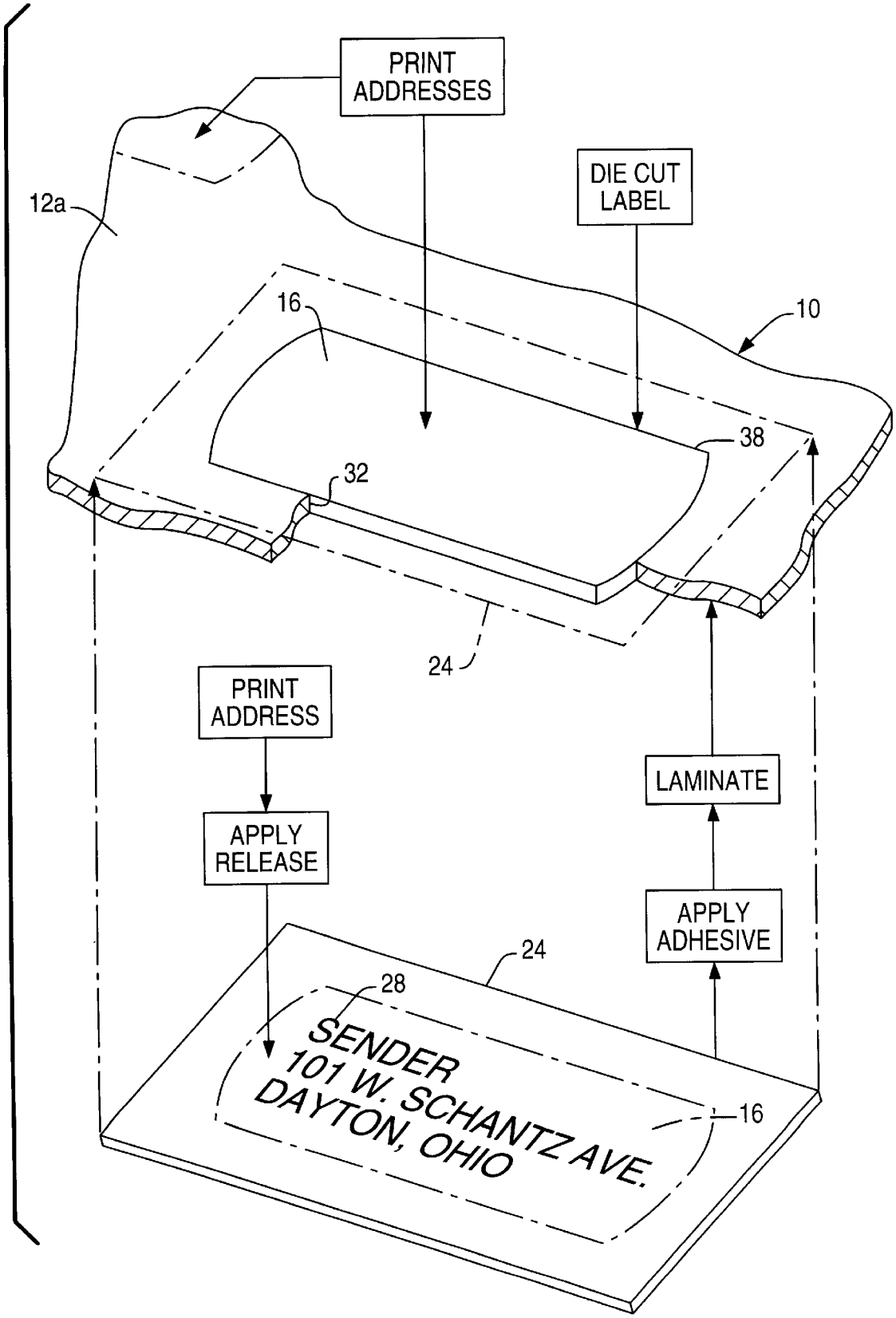
FIG. 5 is an exploded view and corresponding flowchart for the manufacture of the mailer shown in FIGS. 1–4 in accordance an exemplary embodiment.

FIG. 5 illustrates an exploded view of a portion of the mailer 10 and the exemplary construction of the label 16 and liner 24. The liner 24 may have any suitable material composition, such as paper for example, and suitably conditioned for permitting release of the label 16 therefrom. The liner 24 is initially printed with the desired recipient first address 28 so that the printing adheres thereto.

A release agent, such as silicone, is next applied over the front surface of the liner 24. In a preferred embodiment, the release agent is applied solely over the central portion of the liner within the perimeter of the label 16 positioned thereatop. The border of the liner around the first address is without release agent so that it may be permanently bonded to the back side of the face sheet 12*a*.

The liner is suitably laminated to the back side of the face sheet with the adhesive being applied therebetween to permanently bond the border of the liner to the back side of the face sheet, with the label 16 being releasably bonded to the liner over the first address 18.

The face sheet 12*a* is suitably die cut to define the perimeter of the label in a continuous die cut 38 which severs the label from the adjoining face sheet, with the die cut defining the corresponding window 32 upon removal of the label. Since the label 16 is die cut from the face sheet, it is attached thereto by friction along the die cut, as well as by the underlying liner 24 which bridges the window 32 and maintains integrity of the face sheet.

The laminated face sheet and liner may be manufactured in any conventional manner typically from a roll of face sheet stock to which a series of the liners 24 are suitably bonded. The outer profile of the individual containers 10 in unfolded form, as illustrated in FIG. 3, are suitably cut from the roll using conventional die cutters which are also configured for die cutting the individual labels 16 atop the liners 24.

The individual containers are then formed by folding and bonding the respective flaps thereof. During normal use, the recipient first address 18 as well as the return address 22 may then be concurrently printed atop the face of the containers for shipment to the recipients.

A particular advantage of the laminate construction illustrated in FIGS. 4 and 5 is the flush and coplanar integration of the label 16 within the window 32 formed therearound by the continuous die cut 38. This flush configuration reduces the likelihood of premature delamination of the label 16 during shipment. However, in that event, the mailer may be automatically returned to the sender for reprocessing since the sender's address would then be viewable in the window 32.

Although the invention has been disclosed with respect to the particular envelope embodiment illustrated in the figures, it may be applied to various other containers as desired.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A mailer comprising:

a container having an exposed label for printing a recipient first address;

a discrete release liner including a border fixedly joined to said container around said label, and a central portion having a release agent disposed below said label, with said label being releasably bonded to said liner central portion; and said liner contains a recipient second address printed atop said central portion, below said release agent, and hidden behind said label, and viewable upon removal of said label.

2. A method of using said mailer according to claim 1 comprising:

printing said first address atop said label;

sending said mailer to said first address;

removing said label from said liner to expose said second address; and resending said mailer to said second address.

3. A method according to claim 2 wherein said container further includes a return zone for printing a return address, and further comprising reapplying said removed label atop said return zone.

4. A mailer according to claim 1 wherein:

said container comprises a face sheet including a return zone for printing a return address; and said label is coplanar with said face sheet.

5. A mailer according to claim 4 wherein said label is flush with said face sheet.

6. A mailer according to claim 5 wherein said label is a portion of said face sheet having a perimeter severed therefrom.

7. A mailer according to claim 6 wherein said liner border is bonded to said face sheet around said label perimeter.

8. A mailer according to claim 7 wherein said liner is bonded to both said face sheet and label with a common adhesive to releasably bond said label to said liner central portion and to permanently bond said liner border to said face sheet around said label.

9. A mailer according to claim 6 wherein said label has a continuous die cut perimeter severed from said face sheet and attached thereto by said liner.

10. A mailer according to claim 9 wherein said container comprises an envelope.

11. A method of using said mailer according to claim 8 comprising:

printing said first address atop said label;

sending said mailer to said first address;

removing said label from said liner to expose said second address; and resending said mailer to said second address.

12. A method according to claim 11 further comprising reapplying said removed label atop said return zone.

13. A method according to claim 12 wherein said removed label is reapplied to said return zone using said adhesive affixed to said label.

14. A method of making said mailer according to claim 1 comprising:

folding a single sheet of material to form said container;

forming said release liner by firstly printing said second address atop said central portion, and then applying said release agent thereover;

laminating said release liner to said sheet using an adhesive between said liner border and said sheet; and die cutting said sheet to define a perimeter of said label.

15. A method according to claim 14 wherein said release agent is applied to said liner to exclude said border therearound for permanently bonding said liner to said sheet around said border.

16. A method according to claim 15 wherein said sheet is continuously die cut around said label perimeter.

17. A method of making said mailer according to claim 8 comprising:

folding a single sheet of material to form said container;

forming said release liner by firstly printing said second address atop said central portion, and then applying said release agent thereover;

laminating said release liner to said sheet using an adhesive between said liner border and said sheet; and die cutting said sheet to define said label perimeter.

18. A method according to claim 17 wherein said release agent is applied to said liner to exclude said border therearound for permanently bonding said liner to said sheet around said border.

19. A method according to claim 18 wherein said sheet is continuously die cut around said label perimeter.

* * * * *